US011892166B2

(12) United States Patent
Lederlin et al.

(10) Patent No.: US 11,892,166 B2
(45) Date of Patent: Feb. 6, 2024

(54) FUEL INJECTOR WITH A PURGE CIRCUIT FOR AN AIRCRAFT TURBINE ENGINE

(71) Applicant: SAFRAN HELICOPTER ENGINES, Bordes (FR)

(72) Inventors: Thomas Jean Olivier Lederlin, Moissy-Cramayel (FR); Denis Luc Alain Chanteloup, Moissy-Cramayel (FR); Simon Arthur Meilleurat, Moissy-Cramayel (FR)

(73) Assignee: SAFRAN HELICOPTER ENGINES, Bordes (FR)

( * ) Notice: Subject to any disclaimer, the term of this patent is extended or adjusted under 35 U.S.C. 154(b) by 0 days.

(21) Appl. No.: 17/628,393

(22) PCT Filed: Jul. 16, 2020

(86) PCT No.: PCT/FR2020/051274
§ 371 (c)(1),
(2) Date: Jan. 19, 2022

(87) PCT Pub. No.: WO2021/014074
PCT Pub. Date: Jan. 28, 2021

(65) Prior Publication Data

US 2022/0282869 A1 Sep. 8, 2022

(30) Foreign Application Priority Data

Jul. 24, 2019 (FR) ..... 1908419

(51) Int. Cl.
*F23R 3/28* (2006.01)

(52) U.S. Cl.
CPC ..... *F23R 3/283* (2013.01)

(58) Field of Classification Search
CPC ..... F23R 3/28; F23R 3/283; F23R 3/286
See application file for complete search history.

(56) References Cited

U.S. PATENT DOCUMENTS

2009/0044538 A1 2/2009 Pelletier et al.
2010/0269507 A1* 10/2010 Khan ..... F23D 14/24 60/748

(Continued)

FOREIGN PATENT DOCUMENTS

DE 10 2013 208 069 A1 11/2014
DE 10 2017 200 106 A1 7/2018

(Continued)

OTHER PUBLICATIONS

International Search Report dated Nov. 2, 2020, issued in corresponding International Application No. PCT/FR2020/051274, filed Jul. 16, 2020, 7 pages.

(Continued)

*Primary Examiner* — William H Rodriguez
(74) *Attorney, Agent, or Firm* — CHRISTENSEN O'CONNOR JOHNSON KINDNESS PLLC

(57) ABSTRACT

A fuel injector for an aircraft turbine engine includes a tubular body having an axis of elongation. A first longitudinal end configured to be Supplied with fuel and a second longitudinal end configured to elect a jet of fuel. The body further includes an integrated purge-air circuit that has an internal cavity which is connected to air inlet orifices situated on the body and to at least one air outlet situated at said second end. Aire-flow disruptors are provided, projecting into said cavity.

13 Claims, 4 Drawing Sheets

(56) References Cited

U.S. PATENT DOCUMENTS

| | | | | |
|---|---|---|---|---|
| 2014/0190168 | A1 | 7/2014 | Shershnyov et al. | |
| 2015/0285504 | A1 | 10/2015 | Melton | |
| 2017/0328568 | A1* | 11/2017 | Portillo Bilbao ..... | F23R 3/286 |
| 2019/0346140 | A1* | 11/2019 | Kiener ..... | F23D 14/22 |

FOREIGN PATENT DOCUMENTS

| | | | |
|---|---|---|---|
| EP | 2 244 014 | A2 | 10/2010 |
| FR | 2 971 039 | A1 | 8/2012 |
| FR | 3 013 805 | A1 | 5/2015 |
| FR | 3 059 047 | A1 | 5/2018 |
| FR | 3 067 792 | A1 | 12/2018 |
| JP | 2003-247425 | A | 9/2003 |
| JP | 2015-127633 | A | 7/2015 |

OTHER PUBLICATIONS

Written Opinion dated Nov. 2, 2020, issued in corresponding International Application No. PCT/FR20201051274, filed Jul. 16, 2020, 6 pages.

English translation of Written Opinion dated Nov. 2, 2020, issued in corresponding International Application No. PCT/FR2020/051274, filed Jul. 16, 2020, 5 pages.

International Preliminary Report on Patentability dated Jan. 25, 2022, issued in corresponding International Application No. PCT/FR2020/051274, filed Jul. 16, 2020, 7 pages.

* cited by examiner

FUEL INJECTOR WITH A PURGE CIRCUIT FOR AN AIRCRAFT TURBINE ENGINE

FIELD OF THE DISCLOSURE

The present disclosure relates to a fuel injector having a purge circuit for an aircraft turbine engine.

BACKGROUND

The prior art includes in particular the documents FR-A1-2 971 039, FR-A1-3 013 805 and FR-A1-3 067 792.

A mixture of compressed air and suitable fuel is typically injected into a turbine engine combustion chamber using one or more injectors. The injectors are, for example, attached to a casing and pass through orifices in a chamber wall for the fuel ejection into the chamber as a jet of fuel droplets. A fuel injector 10, for example with flat jet, such as the one shown in FIGS. 1 to 5, typically comprises a generally elongate body 12 having an axis of elongation A. The body 12 comprises a first longitudinal end of fuel supply 14 and a second longitudinal end 16 for ejecting a flat jet of fuel. The body 12 is tubular and comprises an internal bore 18 which opens axially at the end 14 and which is connected to a nozzle 20 for the projection of the fuel jet at the end 16.

The body may comprise an air cooling circuit coaxial with the fuel circuit, as described in DE-10.2017. 200106-A1, DE-10.2013.208069-A1 and JP-2003.247425-A.

The body 12 may also comprise at least one integrated air purge circuit which comprises an internal cavity 22 connected to air inlet orifices 24 located on the body and at least one air outlet 26 located at the end 16, as described in EP 2.244.014-A2.

This air circuit has only a purging function and the present disclosure provides an improvement to this technology which allows the operation of a fuel injector to be optimised in a simple, effective and economical manner.

SUMMARY

The present disclosure proposes a fuel injector for an aircraft turbine engine, comprising a tubular body having an axis of elongation A and comprising a first longitudinal end for supplying fuel and a second longitudinal end for ejecting a jet of fuel, the body further comprising an integrated purge air circuit which comprises an internal cavity which is in fluid communication with air supply orifices located on the body and which comprises an annular portion extending around the axis of elongation, the annular portion being connected to air outlet channels opening at the second end, characterised in that air flow disruptors are provided projecting into the annular portion of the internal cavity.

These flow disruptors allow to confer on the air circuit at least one additional function with respect to the purging function. For example, the disruptors can promote the exchange of heat between the air and the body of the injector and thus participate in the cooling of the body of the injector. They can also facilitate the propagation of the jet of fuel and thus optimise the performances of the combustion chamber equipped with this injector.

The injector according to the disclosure may comprise one or more of the following features, taken in isolation from each other or in combination with each other:

- the disruptors comprise projecting annular fins extending into that annular portion about the axis of elongation,
- the disruptors comprising first annular fins projecting from an outer cylindrical surface defining the portion, and second annular fins projecting from an inner cylindrical surface extending around the outer surface,
- the first annular fins are axially spaced apart along the axis of elongation, the second fins also being axially spaced apart along the axis and extending in transverse planes passing substantially between the first fins,
- the cavity comprises two channels diametrically opposed with respect to the axis of elongation and each defining an air outlet at the second end, each of the channels comprising projecting disruptors,
- the disruptors of each of the channels comprise several partitions.
- the partitions are parallel to each other and substantially parallel to the axis of elongation,
- the body is formed in a single piece,
- the first longitudinal end of the body is connected to an attachment base which is formed integrally with the body,
- the second end comprises a generally elongated tubular portion comprising an axis of elongation B substantially perpendicular to the axis of elongation A of the body, the tubular portion having its two open longitudinal ends configured to form respectively two distinct fuel flow inlets intended to meet substantially in the middle of the tubular portion which comprises at least an slot for ejecting a flat jet of fuel.

The present disclosure also relates to an aircraft turbine engine, comprising a combustion chamber equipped with at least one injector.

DESCRIPTION OF THE DRAWINGS

The disclosure will be better understood and other details, characteristics and advantages of the disclosure will become clearer on reading the following description made by way of non-limiting example and with reference to the annexed drawings in which.

DETAILED DESCRIPTION

FIGS. 1 to 5 have been referred to in the foregoing but may serve to better understand the disclosure naturally. These figures and the following figures illustrate the disclosure and show a flat jet injector. Although the disclosure is particularly suited to this type of injector, it is not limited to this injector and is applicable to any type of injector equipped with a purge air circuit.

Figure 6:
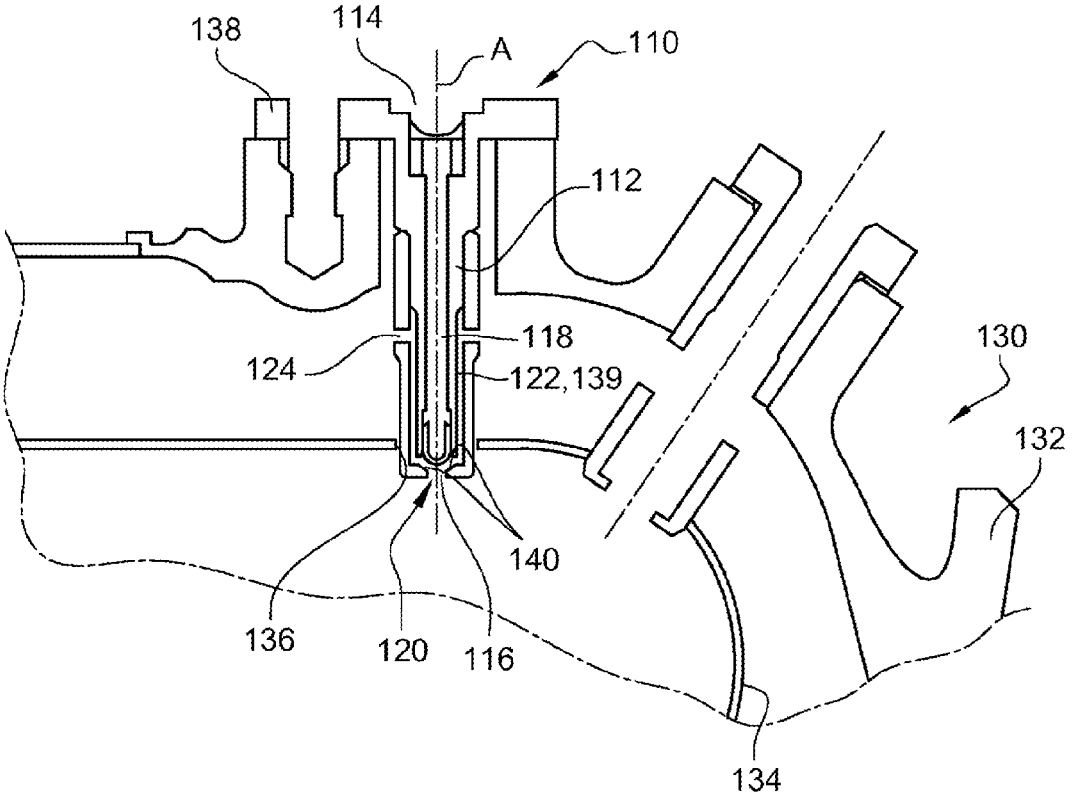
FIG. 6 is a partial schematic axial sectional view of an aircraft turbine engine combustion chamber.

FIG. 6 shows an environment in which a fuel injector 110 according to the disclosure may be used. This is a combustion chamber 130 of an aircraft turbine engine such as a helicopter.

The combustion chamber 130 is disposed within a casing 132 of the turbine engine and comprises a wall 134 internally defining a combustion space into which a mixture of air and fuel is injected and burned.

The fuel is injected into the chamber 130 via one or more injectors 110 which are attached here to the casing 132 and which pass through a port 136 in the wall 134.

The or each injector 110 is of the type shown in FIGS. 1 to 5 and described above.

Figure 1:
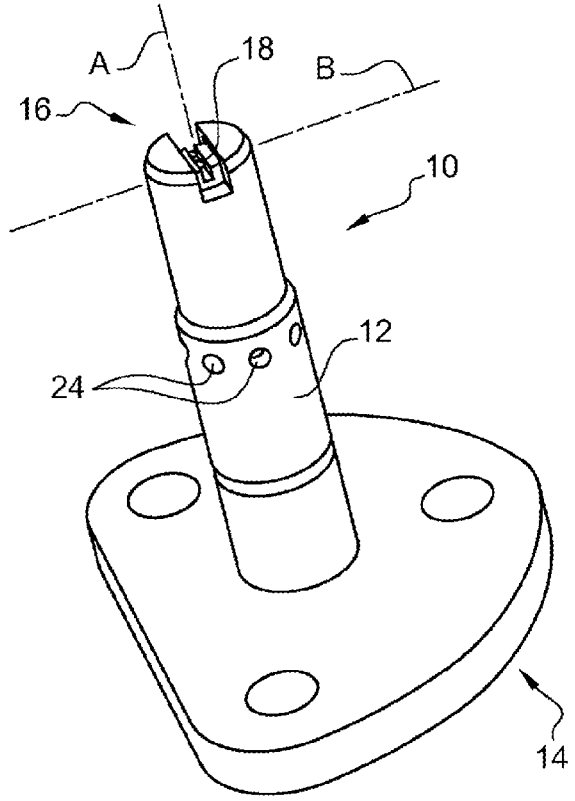
Fig. 1 (PRIOR ART)
FIG. 1 is a schematic perspective view of a flat jet fuel injector for an aircraft turbine engine.
Figure 2:
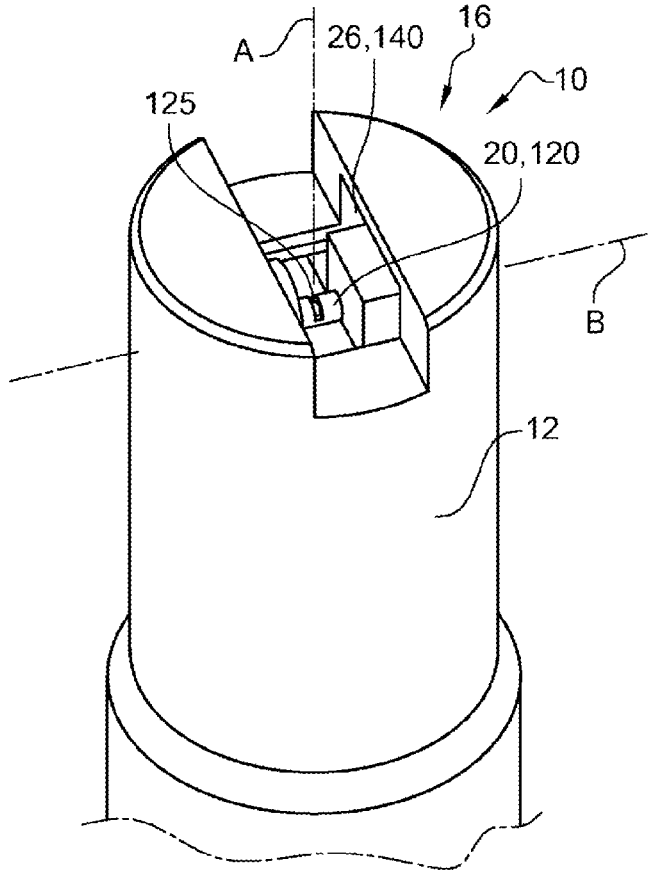
Fig. 2 (PRIOR ART)
FIG. 2 is a larger scale schematic view of part of the injector of FIG. 1.
Figure 3:
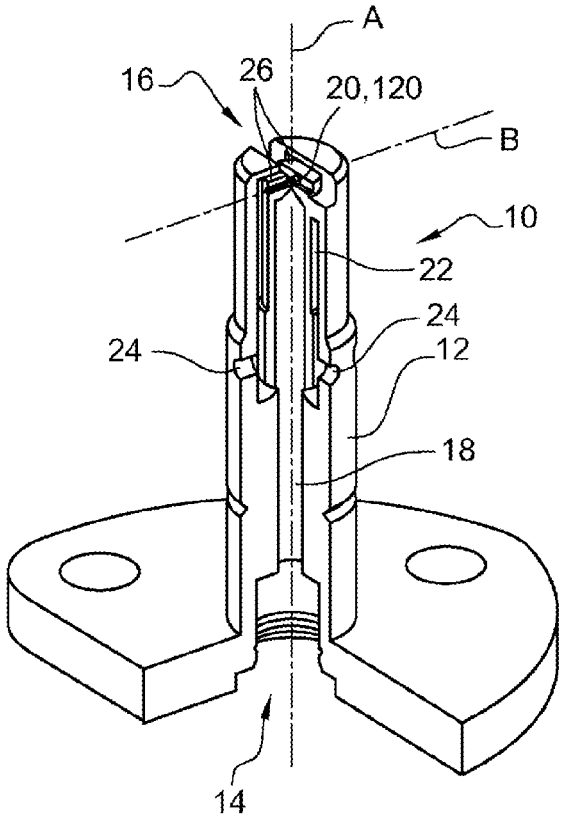
Fig. 3 (PRIOR ART)
FIG. 3 is a schematic perspective and cross-sectional view of the injector of FIG. 1.
Figure 4:
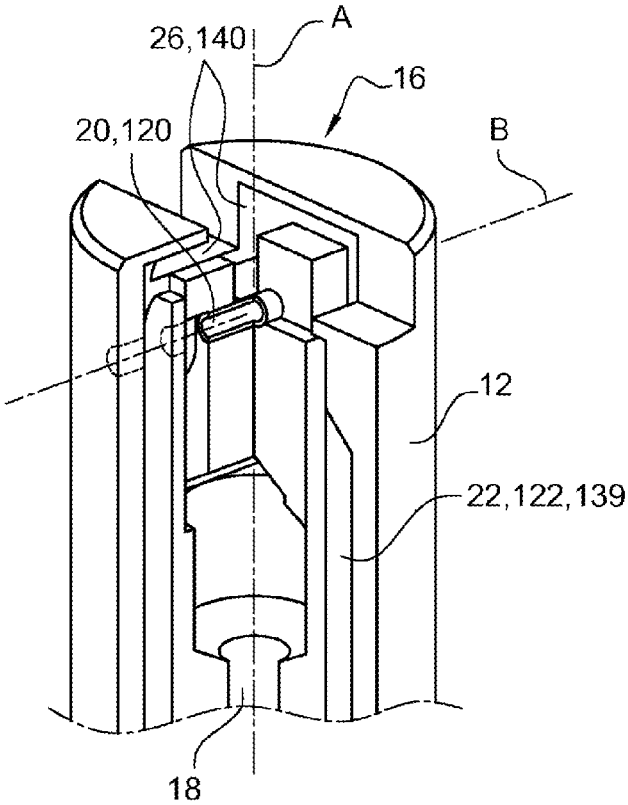
Fig. 4 (PRIOR ART)
FIG. 4 is a larger scale schematic view of a detail of FIG. 3.
Figure 5:
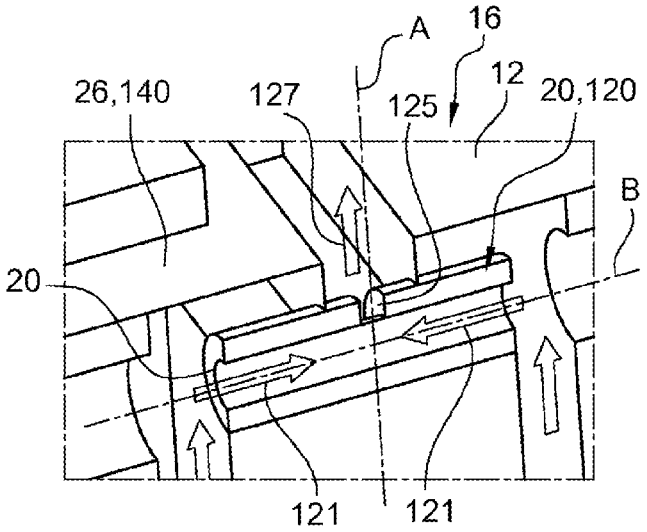
Fig. 5 (PRIOR ART)
FIG. 5 is an even larger scale view of a detail of the injector of FIG. 1.

It comprises a body 112 of generally elongated shape having an axis of elongation A, this body 112 comprising a first longitudinal end 114 for supplying fuel and a second longitudinal end 116 for ejecting a jet of fuel. This second end 116 comprises a nozzle formed by a tubular portion 120 of generally elongated shape having an axis of elongation B substantially perpendicular to the axis of elongation A (FIG. 5 in particular). The tubular portion has its two open longitudinal ends configured to form respectively two distinct fuel flow inlets (arrows 121) intended to meet substantially in the middle of the tubular portion which comprises at least one slot 125 for ejecting the jet of fuel (arrow 127).

Preferably, the body 112 and the tubular portion 120 are made of metal and are obtained in a single piece by machining a metal block, preferably by additive manufacturing.

The first longitudinal end 116 of the body 112, which here comprises a base 138 for attaching to the casing 132, may also be made in a single piece with the body 112. This attachment base 138 comprises a collar extending around the axis A and pierced with orifices for the passage of screws for attaching the injector to the casing 132.

The body 112 includes an internal longitudinal bore 118 extending along and at the axis A, between the first and second longitudinal ends, and in fluid communication with the ends of the tubular portion 120.

The body 112 also includes an internal cavity of air passage 122, which includes an annular portion 139 extending around the bore 118 and channels 140 which open at the end 116 to form the aforementioned purge air outlets. In the example shown, the cavity portion 122 extends along a part of the length of the body 112. It extends to the second longitudinal end 116 of the body 112 and is connected to two channels 140 diametrically opposed with respect to the axis A, which open at this end 116 so that the air is expelled from the injector. When a jet of fuel is ejected from the injector, this jet is surrounded by the air expelled from the same injector. When the injector is not expelling fuel, the expelled air purges the fuel system from the injector. The air then expels the last drops of fuel and cleans the fuel ejection slot 125 of the tubular portion 120. The air passage cavity 122 is thus likened to a purge circuit.

At the end opposite the tubular portion 120, the cavity 122 is in fluid communication with an annular row of air supply orifices 124 formed at the periphery of the body and extending around the axis of elongation A.

Figure 7:
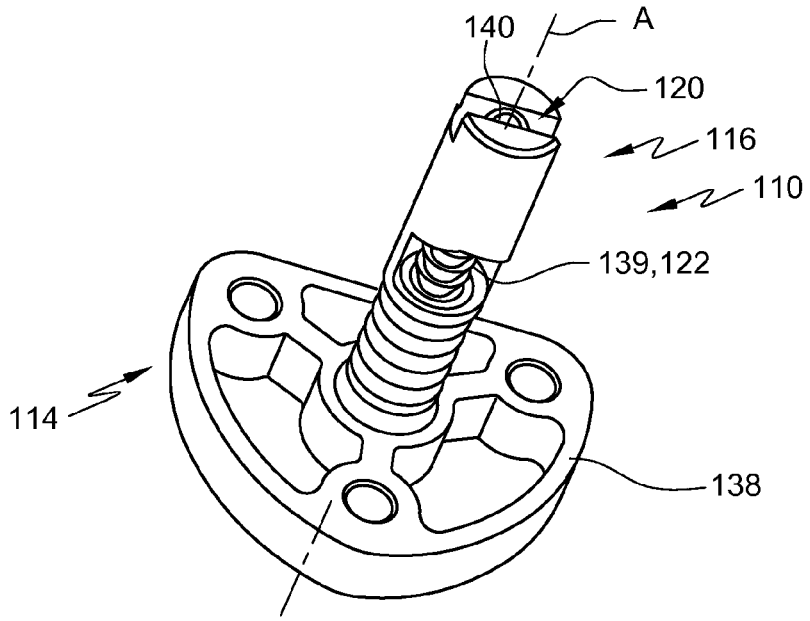
FIG. 7 is a schematic perspective view and partial cross-section of an embodiment of an injector according to the disclosure.
Figure 8:
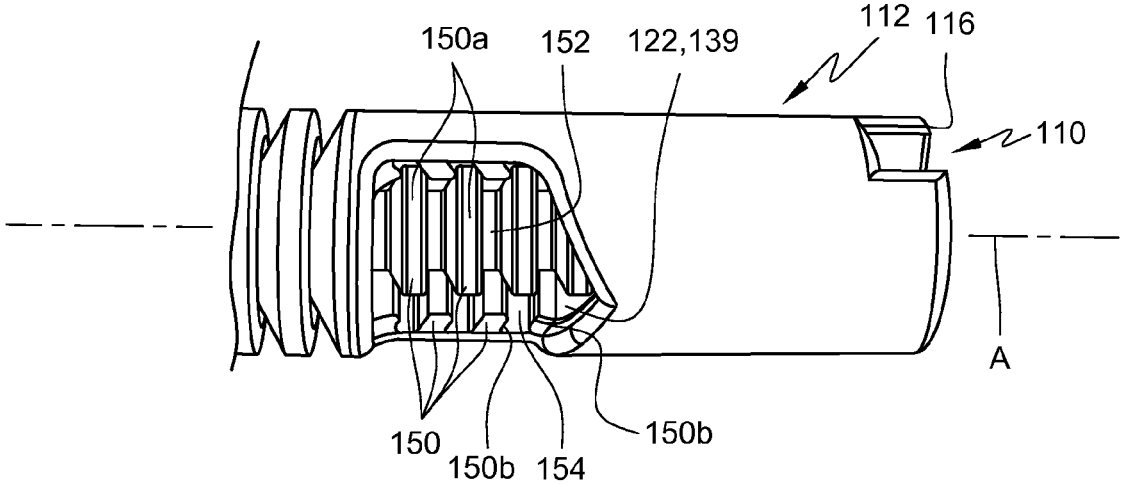
FIG. 8 is a larger scale view of a portion of the injector of FIG. 7.

FIGS. 7 and 8 illustrate a first embodiment of the disclosure in which air flow disruptors 150 are provided in the cavity 122, and more particularly in its annular portion 139.

This annular portion 139 is here defined between two cylindrical surfaces 152, 154 extending around each other and around the axis A.

The disruptors 150 comprise first annular fins 150*a* projecting from the inner cylindrical surface 152, and second annular fins 150*b* projecting from the outer cylindrical surface 154.

The fins 150*a* are axially spaced from each other along the axis A. The fins 150*b* are also axially spaced apart along this axis A and extend in transverse planes passing substantially between the fins 150*a*.

The fins 150*a*, 150*b* may be rectangular, triangular or trapezoidal in axial cross-section. The fins 150*a* may have a different cross-sectional shape to the fins 150*b*, as in the example shown. They may have a thickness or axial dimension substantially equal to their height or radial dimension (measured from the axis A).

The number of fins 150*a*, 150*b* on each surface 152, 154 is for example between 3 and 15 and preferably between 5 and 10.

In operation, the air entering the portion 139 of the cavity 122, through the orifices 124, has to bypass the fins 150*a*, 150*b* and suffers pressure losses due to the baffle effect. This phenomenon contributes to the cooling of the body 112 of the injector 110.

Figure 9:
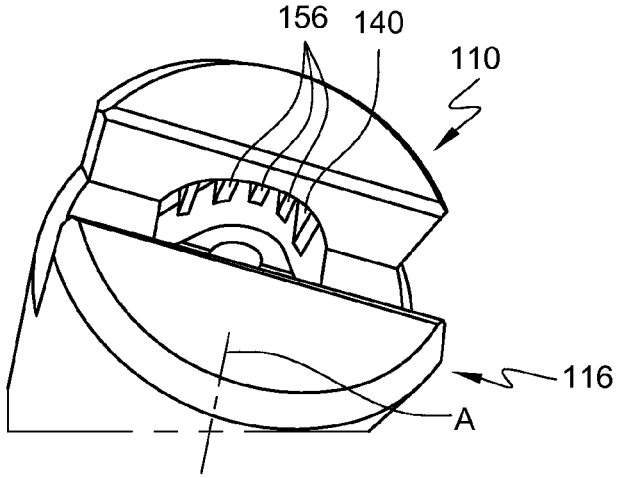
FIG. 9 is a partial schematic perspective view of another embodiment of an injector according to the disclosure.

FIG. 9 illustrates an alternative embodiment which can be combined with the previous embodiment.

Each of the channels 140 comprises projecting disruptors 156.

The disruptors 156 of each of the channels 140 comprise several partitions, which are here parallel to each other and substantially parallel to the axis A.

The number of disruptors 156 or partitions per channel 140 is for example between 3 and 10.

In operation, the air leaving the purge circuit is guided by the partitions so as to optimise the formation and diffusion of the fuel jet, for example in the direction of a spark plug of the combustion chamber 130 equipped with the injector 110.

The injector 110 according to the disclosure may be produced by additive manufacturing, for example, and is advantageously monobloc.

The invention claimed is:

1. A fuel injector for an aircraft turbine engine, comprising a tubular body having an axis of elongation and comprising a first longitudinal end configured to supply fuel and a second longitudinal end configured to eject a jet of fuel, said body further comprising an integrated purge air circuit which comprises an internal cavity in fluid communication with air supply orifices located on the body and which comprises an annular portion extending around said axis of elongation and connected to air outlet channels opening at said second end, wherein air flow disruptors are provided projecting into the annular portion of said internal cavity, wherein said second end comprises a elongated tubular portion comprising an axis of elongation substantially perpendicular to said axis of elongation of said body, said elongated tubular portion having two longitudinal ends which are opened and which are configured to form respectively two inlets distinct for two fuel flows intended to meet together at the middle of said elongated tubular portion, said elongated tubular portion comprising at least one slot for ejecting a flat jet of fuel.

2. The injector according to claim 1, wherein the disruptors comprise projecting annular fins extending into the annular portion about said axis of elongation.

3. The injector according to claim 2, wherein the disruptors comprise first annular fins projecting from an outer cylindrical surface defining said portion, and second annular fins projecting from an inner cylindrical surface extending around said outer surface.

4. The injector according to claim 3, wherein the first annular fins are axially spaced apart along said axis of elongation, the second fins also being axially spaced apart along said axis and extending in transverse planes passing substantially between the first fins.

5. The injector according to claim 3, wherein said first annular fins are not connected to said inner cylindrical surface, and wherein said second annular fins are not connected to said outer cylindrical surface.

6. The injector according to claim 1, wherein said cavity comprises two channels diametrically opposed with respect to said axis of elongation and each defining an air outlet at said second end, each of the channels comprising projecting disruptors.

7. The injector according to claim 6, wherein the disruptors of each of the channels comprise several partitions.

8. The injector according to claim 7, wherein the partitions are parallel to each other and parallel to said axis of elongation.

9. The injector according to claim 1, wherein said body is formed in a single piece.

10. The injector according to claim 1, wherein said first longitudinal end of said body is connected to an attachment base which is formed integrally with said body.

11. An aircraft turbine engine, comprising a combustion chamber equipped with at least one injector according to claim 1.

12. A fuel injector for an aircraft turbine engine, comprising a tubular body having an axis of elongation and comprising a first longitudinal end configured to supply fuel and a second longitudinal end configured to eject a jet of fuel, said body further comprising an integrated purge air circuit which comprises an internal cavity in fluid communication with air supply orifices located on the body and which comprises an annular portion extending around said axis of elongation and connected to air outlet channels opening at said second end, wherein air flow disruptors are provided projecting into the annular portion of said internal cavity, wherein said cavity comprises two channels diametrically opposed with respect to said axis of elongation and each defining an air outlet at said second end, each of the channels comprising projecting disruptors, wherein the disruptors of each of the channels comprise several partitions, and wherein the partitions are parallel to each other and parallel to said axis of elongation.

13. The injector according to claim 1, wherein the annular portion and the air outlet channels are arranged radially around a fuel channel of the tubular body and/or the second longitudinal end configured to eject a jet of fuel.

* * * * *